US005242029A

United States Patent [19]

Marcella

[11] Patent Number: 5,242,029

[45] Date of Patent: Sep. 7, 1993

[54] POOLSIDE DESCENDING SCAFFOLD

[76] Inventor: Frank V. Marcella, 3 Stanley Avenue, Pleasantville, N.Y. 10570

[21] Appl. No.: 817,241

[22] Filed: Jan. 6, 1992

[51] Int. Cl.[5] ..... E04G 3/00

[52] U.S. Cl. ..... 182/82; 182/150; 182/100; 248/364

[58] Field of Search ..... 182/82, 150, 45, 113, 182/100; 248/364

[56] References Cited

U.S. PATENT DOCUMENTS

| | | | |
|---|---|---|---|
| 1,442,697 | 1/1923 | Orthmann | 182/150 X |
| 3,302,011 | 1/1967 | Katzel | 248/364 X |
| 4,253,547 | 3/1981 | Skaalen et al. | 182/63 X |
| 4,256,201 | 3/1981 | Neighbors | 182/150 X |
| 4,892,170 | 1/1990 | O'Donnell | 182/100 |
| 5,065,838 | 11/1991 | Finley | 182/150 X |
| 5,145,153 | 9/1992 | Glynn | 256/DIG. 6 X |

FOREIGN PATENT DOCUMENTS

| | | | |
|---|---|---|---|
| 3719403 | 12/1987 | Fed. Rep. of Germany | 182/45 |

*Primary Examiner*—Alvin C. Chin-Shue

[57] ABSTRACT

The invention is a poolside descending scaffold having an apron bar which is extendable by an apron arm extender fitted into its two end pieces, which are rectangular box girders of light metal or steel. End pieces are affixed to the extender by pad bars with threaded internal pins. The pad rods carry pads which are of sufficient area to prevent rotation of the apron bar. The pads may be simple flat metal pads or may be eccentric blocks or screw pads useful in leveling the apron bar. The apron bar has a weight basket at its distal end and a hinge bracket at its poolside end. The hinge bracket holds a descending bar at a position along its length determined by a pin through one of a set of holes in the descending bar and through holes in the hinge bracket. The descending bar has ladder pins to ease the climb between poolside apron and scaffold plank, and a bumper bar on a threaded pin which can also serve to affix the plank bracket to the descending bar.

8 Claims, 1 Drawing Sheet

POOLSIDE DESCENDING SCAFFOLD

BACKGROUND OF THE INVENTION

1. Field of the Invention

This invention relates to scaffolds, and particularly relates to a simple, inexpensive, safe and easy-to-operate poolside descending scaffold for use in building and repairing swimming pools.

2. Description of Related Art

Scaffold technology is very old. There is a wealth of prior art for ascending from ground level to great heights. There are a number of designs for window scaffolds which hang from window openings and provide a sort of mobile balcony, useful for washing windows or other outside activities (See U.S. Pat. Nos. 1,318,479, 1,458,744 and 2,106,002). There are descending scaffolds hung from roof-level parapets and from the sides of ships or drydocks (See U.S. Pat. No. 3,900,080). All these types of scaffolding are characterized by semipermanent attachments to a feature of the wall they ascend or descend, often with descending chains or ropes to provide the support for the scaffold floor, usually a plank. Swimming pool technology is relatively new. The popularity of swimming pools for individual homes has grown. Such pools are relatively small and relatively shallow, and must in most cases be built and repaired on a budget. Swimming pool scaffolds have varied from a plank set on two horses to a plank set on ladder jacks to various contraptions and boxes upon which to stand. The need has persisted for a simple, economical poolside descending scaffold.

SUMMARY OF THE INVENTION

It is the object of the invention to provide an elegant poolside descending scaffold which is economical, safe and easy-to-use.

A feature of the invention is an adjustable length weighted apron bar which provides the positioning and support for a descending platform support bar which is pinned to the apron bar.

An advantage of the invention is its elegant simplicity, which makes it safe, economical and easy-to-use.

Another advantage is its ability to accommodate to a range of apron widths and pool depths, while retaining easy portability both poolside and van-top.

Other objects, features and advantages of the invention will be apparent from the following specification and from the annexed drawings and claims.

DETAILED DESCRIPTION OF THE PREFERRED EMBODIMENT

Figure 1:
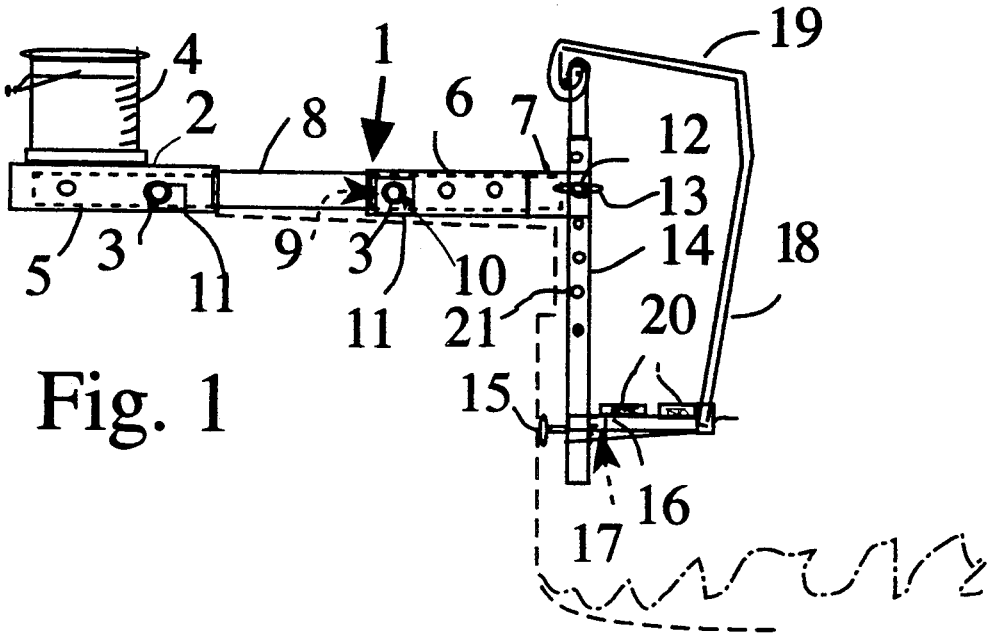
FIG. 1 is an isometric view of the descending poolside scaffold in use.
Figure 2:
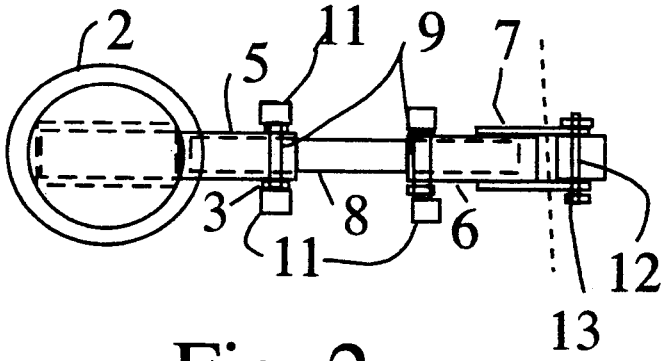
FIG. 2 is a plan view of the weighted apron bar.

FIGS. 1 and 2 show the descending poolside scaffold in use. Apron bar 1 preferably is steel or aluminum box girder of a standard size such as 75 mm. inner dimension. It carries weight basket 2, and pad rods 3, added weight bucket 4 and is divided by a central cut into basket end length 5 and poolside end length 6. Weight basket 2 is affixed to the basket end of basket end length 5, preferably by welding. Hinge bracket 7 is affixed, preferably by welding, to the poolside end of poolside end length 6.

Figure 3:
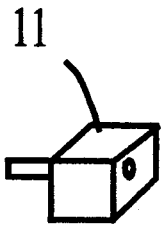
FIG. 3 is a detail of adjustable height pads using eccentric blocks.
Figure 4:
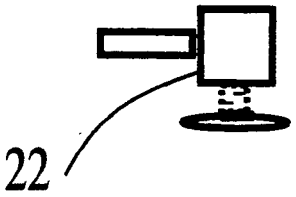
FIG. 4 is a detail of adjustable height pads using screw pads.

Lengths 5 and 6 of apron bar 1 are connected together by apron bar extender 8, which is preferably an aluminum or steel box girder of outer dimension 75 mm., which fits snugly into apron bar lengths 5 and 6 and is secured by pad rods 3. Pad rods 3 preferably are cut in two with their cut ends internally threaded to fit over an externally threaded inner pad rod 9 which passes through holes 10 in apron bar lengths 5 and 6 and in apron bar extender 8. Pad rods 3 and 4 are fitted with pads 11 which may be simple flat pads or may be eccentric blocks of varying dimension, as shown in FIG. 3, so as to help in leveling on uneven surfaces of concrete or grass apron pads 11 may be equipped with adjustable height devices such as screw pads 22, as shown in FIG. 4.

Hinge bracket 7 has hinge pin 12 and locknut 13 to affix the poolside descending scaffold descending bar 14 at a convenient height selected by choice of holes along its length. Descending bar 14 may be aluminum or steel box girder of dimensions similar to those of apron bar lengths 5 and 6. Although not generally preferred, descending bar 14 may be cut in two and completed by a descending bar extender similar to apron bar extender 8, so as to permit short lengths of parts for easy portability. Descending bar 14 is completed by poolside bumper pad 15, which is preferably adjustable, and by scaffold plank support 16. Scaffold plank support 16 preferably shares a threaded pin 17 which is screwed in to define the depth and distance from the poolside wall.

The poolside descending scaffold is preferably used in groups of three or more, to allow easy access to a significant distance about the inner periphery of the pool.

Although not preferred, if required a railing upright 18 may be supported by scaffold plank support 16 and connection 19 to descending bar 14. Pool depth is normally insignificant beneath the planks 20, which makes a rail not necessary.

OPERATION

The poolside descending scaffold may be partially disassembled for carrying it to the job site on top of a van, or more fully disassembled into short lengths for carrying in the trunk of a car.

At poolside, the apron bar lengths 5 and 6 are assembled with apron bar extender 8 and pinned by pad rods 3 and 4. Descending bar 14 is affixed to hinge bracket 7 by pin 12 and pin nut 13. Poolside bumper 15 is tentatively positioned by screwing bumper pin 17 to an intermediate position; plank support bracket 16 is similarly tentatively positioned. The poolside descending scaffold is carried, rolled or dragged to the appropriate position on the periphery of the pool, and the descending bar 14 is lifted down into place. Pad rods 3 have their pads 11 adjusted for level support. A concrete block or five-gallon pail of water or pool chemical or paint is positioned in the weight basket 2.

One or more additional poolside descending scaffold supports are positioned, and the scaffold planks 20 are carefully put in place. The scaffold is now in position for use. The pool worker may use a ladder, or more likely use ladder pins 21 affixed to descending bar 14 to climb down onto the scaffold planks 20.

The weight in weight basket 2 need not be very heavy because of the lever arm length of the apron bar 1. Twenty kilograms of water weight in weight basket 2 will safely support the weight of a hundred kilogram human even with the very short lever arm of apron bar 1 in its least extended condition.

While the invention has been shown preferably in the form of a poolside descending scaffold, it will be clear to those skilled in the art that the modifications described as alternatives, plus other alternatives, may be pursued without departing from the spirit and scope of the invention, as defined in the following claims:

What is claimed is:

1. A poolside descending scaffold comprising:

a) a single apron arm (1) having a weight basket (2) at a distal end and a hinge bracket (7) at a poolside end;

b) a descending bar (14) affixable to said hinge bracket (7);

c) means to affix said descending bar (14) to said apron arm (1) at said hinge bracket (7); and d) a scaffold plank support member attached to said descending bar and extending horizontally outwardly therefrom in a direction opposite to an extending direction of said apron arm.

2. A poolside descending scaffold according to claim 1, comprising an apron arm extender (8); wherein said apron arm (1) is divided into a plurality of apron arm lengths (5,6) and said apron arm extender (8) joins two of said plurality of apron arm lengths (5,6).

3. A poolside descending scaffold according to claim 1, wherein said weight basket (2) is dimensioned to support a five gallon pail.

4. A poolside descending scaffold comprising:

a) a single apron arm (1) having a poolside end and a distal end, and being made up of a plurality of apron arm lengths (5, 6) having a weight basket (2) at a distal end and having a hinge bracket (7) at a poolside end;

b) a descending bar (14) affixable to said hinge bracket (7);

c) hinge means (12, 13) to affix said descending bar (14) to said apron arm (1) at said hinge bracket (7);

d) apron arm extender (8) arranged to join two of said plurality of apron arm lengths (5, 6); and e) apron arm extender affixing means (3) including at least one pad bar (3, 11) arranged to provide stability while locking said apron arm extender (8) to one of said plurality of apron arm lengths (5, 6).

5. A poolside descending scaffold according to claim 4, comprising a plurality of adjustable height pads wherein said pad bars (3,4) have distal ends and said adjustable height pads are affixable to said pad bar distal ends.

6. A poolside descending scaffold according to claim 5, wherein said adjustable height pads are eccentric blocks.

7. A poolside descending scaffold according to claim 5, wherein said adjustable height pads are screw pads.

8. A poolside descending scaffold comprising:

a) a single apron arm (1) having a poolside end and a distal end, and being made up of a plurality of apron arm lengths (5, 6) having a weight basket (2) dimensioned to support a five gallon pail at a distal end, and having a hinge bracket (7) at a poolside end;

b) a descending bar (14) affixable to said hinge bracket (7);

c) hinge means (12,13) to affix said descending bar (14) to said apron arm (1) at said hinge bracket (7);

d) apron arm extender (8) arranged to join two of said plurality of apron arm lengths (5, 6); and e) apron arm extender affixing means (3) including at least one pad bar (3, 11) arranged to provide stability while locking said apron arm extender (8) to one of said plurality of apron arm lengths (5, 6).

* * * * *